US010794638B2

(12) United States Patent
Vucenic et al.

(10) Patent No.: US 10,794,638 B2
(45) Date of Patent: Oct. 6, 2020

(54) STRUCTURALLY SUPPORTED HEAT EXCHANGER

(71) Applicant: Dana Canada Corporation, Oakville (CA)

(72) Inventors: Nik Vucenic, Oakville (CA); Benjamin A. Kenney, Oakville (CA); Takayuki Fukada, Oakville (CA)

(73) Assignee: DANA CANADA CORPORATION, Oakville (CA)

( * ) Notice: Subject to any disclaimer, the term of this patent is extended or adjusted under 35 U.S.C. 154(b) by 76 days.

(21) Appl. No.: 16/103,079

(22) Filed: Aug. 14, 2018

(65) Prior Publication Data

US 2019/0234695 A1 Aug. 1, 2019

Related U.S. Application Data

(60) Provisional application No. 62/623,260, filed on Jan. 29, 2018.

(51) Int. Cl.

| | |
|---|---|
| ***F28F 3/00*** | (2006.01) |
| ***F28F 3/04*** | (2006.01) |
| ***F28F 3/12*** | (2006.01) |
| *F28D 9/00* | (2006.01) |
| *F28D 1/03* | (2006.01) |

(52) U.S. Cl.

CPC ..... *F28F 3/044* (2013.01); *F28F 3/042* (2013.01); *F28F 3/048* (2013.01); *F28F 3/12* (2013.01); *F28D 1/035* (2013.01); *F28D 9/0056* (2013.01)

(58) Field of Classification Search

CPC .. F28F 3/044; F28F 3/042; F28F 3/048; F28F 3/12; F28D 9/0037; F28D 1/035

USPC ..... 165/166

See application file for complete search history.

(56) References Cited

U.S. PATENT DOCUMENTS

| | | | | |
|---|---|---|---|---|
| 4,635,714 | A | 1/1987 | Almqvist | |
| 5,517,757 | A | 5/1996 | Hayashi | |
| 6,047,769 | A * | 4/2000 | Shimoya | F28D 1/0333 165/148 |

(Continued)

FOREIGN PATENT DOCUMENTS

| | | | |
|---|---|---|---|
| CN | 106123668 | A | 11/2016 |
| JP | 408271173 | A | 10/1996 |

(Continued)

OTHER PUBLICATIONS

Canadian Intellectual Property Office, International Search Report and Written Opinion Issued in Application PCT/CA2018/050980, dated Nov. 1, 2018, 8 pages, Canadian Intellectual Property Office, Gatineau, Quebec CA.

*Primary Examiner* — Davis D Hwu

(74) *Attorney, Agent, or Firm* — McCoy Russell LLP

(57) ABSTRACT

A heat exchanger plate having a planar plate having an inlet and outlet proximate to a first edge of the heat exchanger plate. The planar plate having a plurality of ribs and a plurality of channels, with the plurality of channels being in a plane different from the planar plate. The plurality of channels being in fluid communication from the inlet to the outlet permitting fluid flow from the inlet to the outlet. A protrusion coupled to the planar plate proximate to the first edge of the heat exchanger plate and laterally extending from an axis, with the heat exchanger plate being susceptible to bending about the axis.

19 Claims, 10 Drawing Sheets

(56) References Cited

U.S. PATENT DOCUMENTS

| | | | | |
|---|---|---|---|---|
| 6,241,011 | B1 | 6/2001 | Nakamura | |
| 6,401,804 | B1 * | 6/2002 | Shimoya | F28D 1/0333 165/133 |
| 8,074,708 | B2 | 12/2011 | Sugito | |
| 8,181,695 | B2 | 5/2012 | Bradu | |
| 8,544,532 | B2 | 10/2013 | Bradu | |
| 2006/0196649 | A1 * | 9/2006 | Shibata | F28D 9/0037 165/166 |
| 2007/0084809 | A1 | 4/2007 | Bradu | |
| 2008/0159848 | A1 | 7/2008 | Liu | |
| 2008/0202735 | A1 * | 8/2008 | Geskes | F28D 9/0006 165/166 |
| 2009/0193831 | A1 | 8/2009 | Kim | |
| 2016/0003553 | A1 * | 1/2016 | Campbell | H01M 10/625 165/166 |

FOREIGN PATENT DOCUMENTS

| | | | |
|---|---|---|---|
| JP | 2007275367 | A | 10/2007 |
| JP | 2009103360 | A | 5/2009 |
| JP | 2013194962 | A | 9/2013 |
| WO | 2012126111 | | 9/2012 |
| WO | 2016109881 | | 7/2016 |
| WO | 2017070785 | | 5/2017 |
| WO | 2018112619 | | 6/2018 |

* cited by examiner

STRUCTURALLY SUPPORTED HEAT EXCHANGER

CROSS REFERENCE TO RELATED APPLICATION

This application claims the benefit of and priority to U.S. Patent Provisional Application No. 62/623,260, filed Jan. 29, 2018 under the title STRUCTURALLY SUPPORTED HEAT EXCHANGER. The content of the above patent application is hereby expressly incorporated by reference into the detailed description hereof.

FIELD

The specification relates to a heat exchanger plate having a structural support feature, and heat exchangers formed from such heat exchanger plates.

BACKGROUND

Down gauging of heat exchanger plates and heat exchanger formed from such plates can be desirable to reduce the overall weight of the heat exchanger and the contribution of the weight of a heat exchanger to a device or vehicle. However, down-gauging can also result in heat exchanger failure. For instance, heat exchanger placed in a vehicle or device can experience vibration that can lead to bending of the heat exchanger or heat exchanger plate, and result in one or more weak points, or leaks; which can eventually lead loss in efficiency and performance of the heat exchanger.

There is a need in the art for a heat exchanger plate having features that can help to strengthen the heat exchanger plate or heat exchanger. Preferably, such features can help with strengthening the heat exchanger plate without significantly impacting the weight of the heat exchanger plate or heat exchanger. In addition, there is a need in the art for a heat exchanger plate having features that can help prevent bending of the heat exchanger plate or heat exchanger. Moreover, there is a need in the art for a heat exchanger plate having features that can mitigate the impact of vibration forces on a heat exchanger plate or heat exchanger.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

SUMMARY

Figure 1:
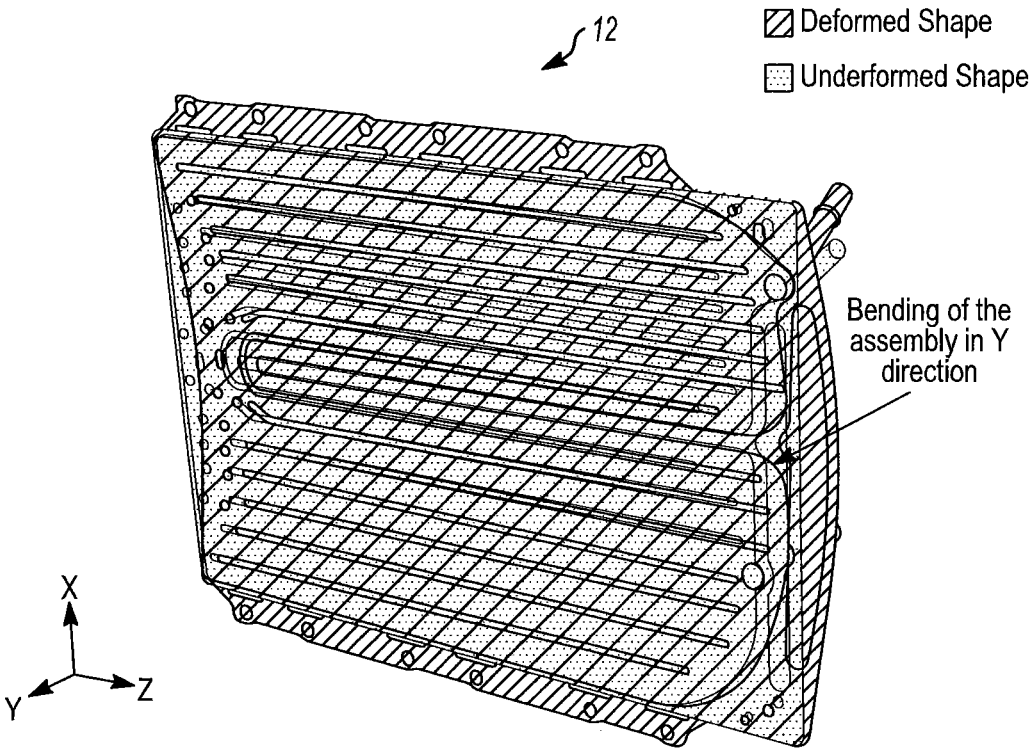
FIG. 1 is a perspective view of heat exchanger plate in accordance with a first embodiment showing direction of bending of a plate.

In one aspect, the specification relates to a heat exchanger plate having:

a planar plate having an inlet and outlet proximate to a first edge of the heat exchanger plate; the planar plate having a plurality of ribs and a plurality of channels, with the base of the plurality of channels being in a plane different from the planar plate, the plurality of channels being in fluid communication from the inlet to the outlet permitting fluid flow from the inlet to the outlet; and a protrusion coupled to the planar plate proximate to the first edge of the heat exchanger plate and extending away from an axis, with the heat exchanger plate being susceptible to bending about the axis.

In one embodiment, the protrusion coupled to the planar plate proximate to the first edge of the heat exchanger plate extends laterally away from an axis, with the heat exchanger plate being susceptible to bending about the axis.

In one embodiment, the heat exchanger planar plate provides a U-shaped fluid flow path from the inlet to the outlet.

In one embodiment, the heat exchanger planar plate has a central rib extending along the length of the heat exchanger plate, the central rib separating the planar plate into an inlet side and an outlet side; and wherein the axis extends in line with the central rib.

In one embodiment, the heat exchanger plate protrusion intersects the axis, the protrusion being bar shaped with a centrally positioned pimple-shaped projection that projects from the protrusion along the central rib towards an edge of the heat exchanger plate that is opposed to the first edge.

In one embodiment, the heat exchanger plate protrusion is a longitudinal shaped dimple positioned adjacent to the first edge of the heat exchanger plate, the longitudinal shaped dimple intersecting the axis along which the heat exchanger plate is susceptible to bending.

In one embodiment, the heat exchanger plate protrusion has a triangular shape and extends from the first edge of the heat exchanger plate, the apex of the triangular shaped protrusion being proximate to and in line with the central rib.

In one embodiment, the heat exchanger plate protrusion is a flange extending from the first edge of the heat exchange plate.

In one embodiment, the heat exchanger plate has a protrusion that has a triangular shape and coupled adjacent to the first edge of the heat exchanger plate, the apex of the triangular shaped protrusion being proximate to and in line with the central rib.

In one embodiment, the heat exchanger plate has a first protrusion and a second protrusion, the first protrusion being longitudinal and coupled to the planar plate proximate to the first edge of the heat exchanger plate and laterally extending from the axis, with the heat exchanger plate being susceptible to bending about the axis; and the second protrusion being V-shaped with the apex of the V-shaped protrusion being aligned with the central rib of the heat exchanger plate.

In one embodiment, the heat exchanger plate has a protuberance positioned in the channel proximate to an edge opposed to the first edge, the protuberance intersects the axis about which the heat exchanger is susceptible to bending and extends laterally away towards the longitudinal edges of the heat exchanger plate.

In one embodiment, the heat exchanger plate has a plurality of nipples formed in the channel and extending in the fluid passage.

In one embodiment, the heat exchanger plate has a plurality of nipples are formed proximate to an edge opposed to the first edge.

In one embodiment, the heat exchanger plate has a manifold portion and a heat exchanger portion, the heat exchanger plate provided with a plurality of protrusions between the manifold portion and the heat exchange portion; and wherein the heat exchanger is susceptible to bending in between the manifold portion and the heat exchanger portion.

In one embodiment, the heat exchanger plate has an axis about which the heat exchanger plate is susceptible to bending perpendicular to the length of the heat exchanger plate.

In one embodiment, the heat exchanger plate has a plurality of protrusions are at an angle from the length of the heat exchanger plate.

DESCRIPTION

Typical plate-type heat exchangers should be known to a person of ordinary skill in the art. Some types of heat exchangers are formed by a plurality of plate pairs, while in some others, the heat exchanger is formed using a single plate pair. The plate pair together provide for a fluid channel for flow of a heat exchanger fluid from an inlet of the heat exchanger to the outlet of the heat exchanger, with the peripheral edges of the plate pairs being sealed to each other to prevent leakage of the heat exchanger fluid from the plate pair. Examples of some heat exchangers are shown in, for instance, PCT International Patent Publication Nos. WO 2012/126111, WO 2016/109881A1, WO/2017/070785, and PCT International Patent Application No. PCT/CA2017/051540, incorporated herein by reference.

Figure 2:
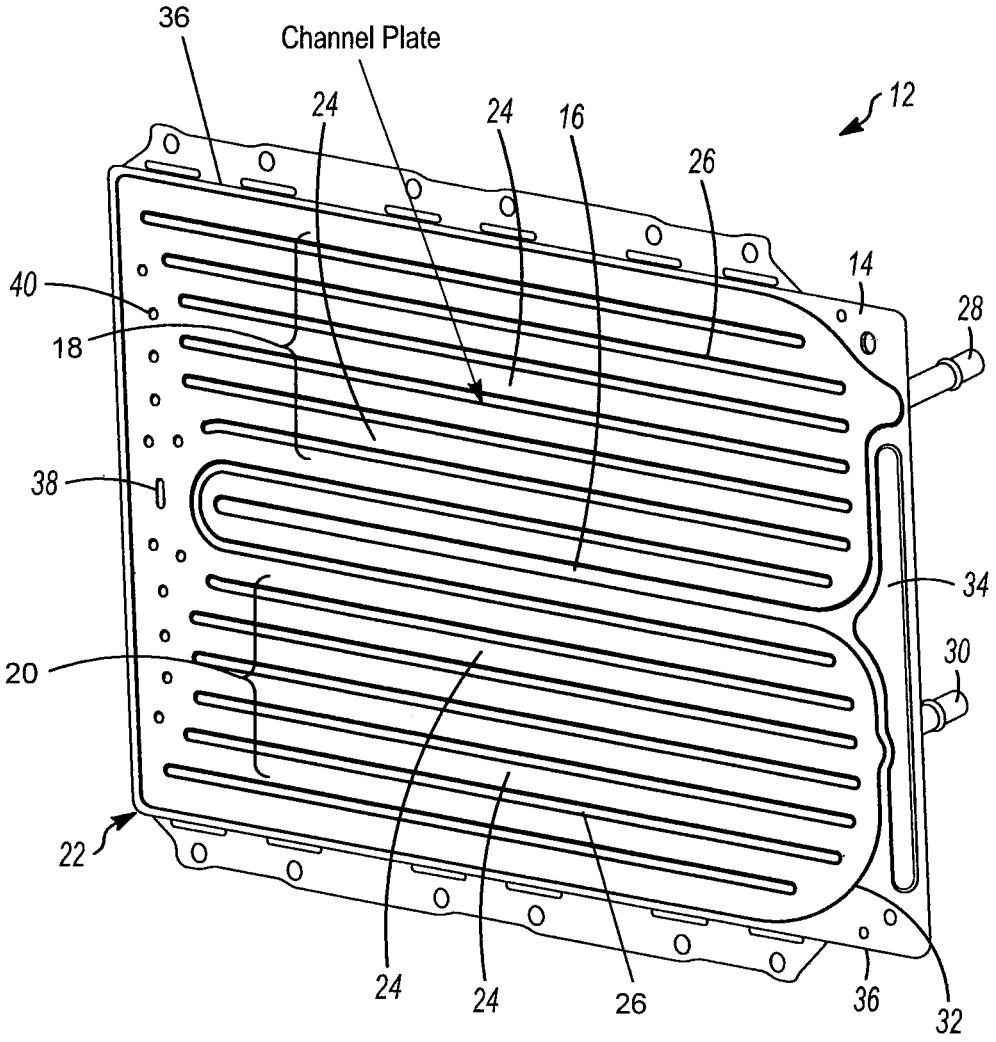
FIG. 2 is a perspective view of heat exchanger plate in accordance with a first embodiment disclosed in the specification.
Figure 3:
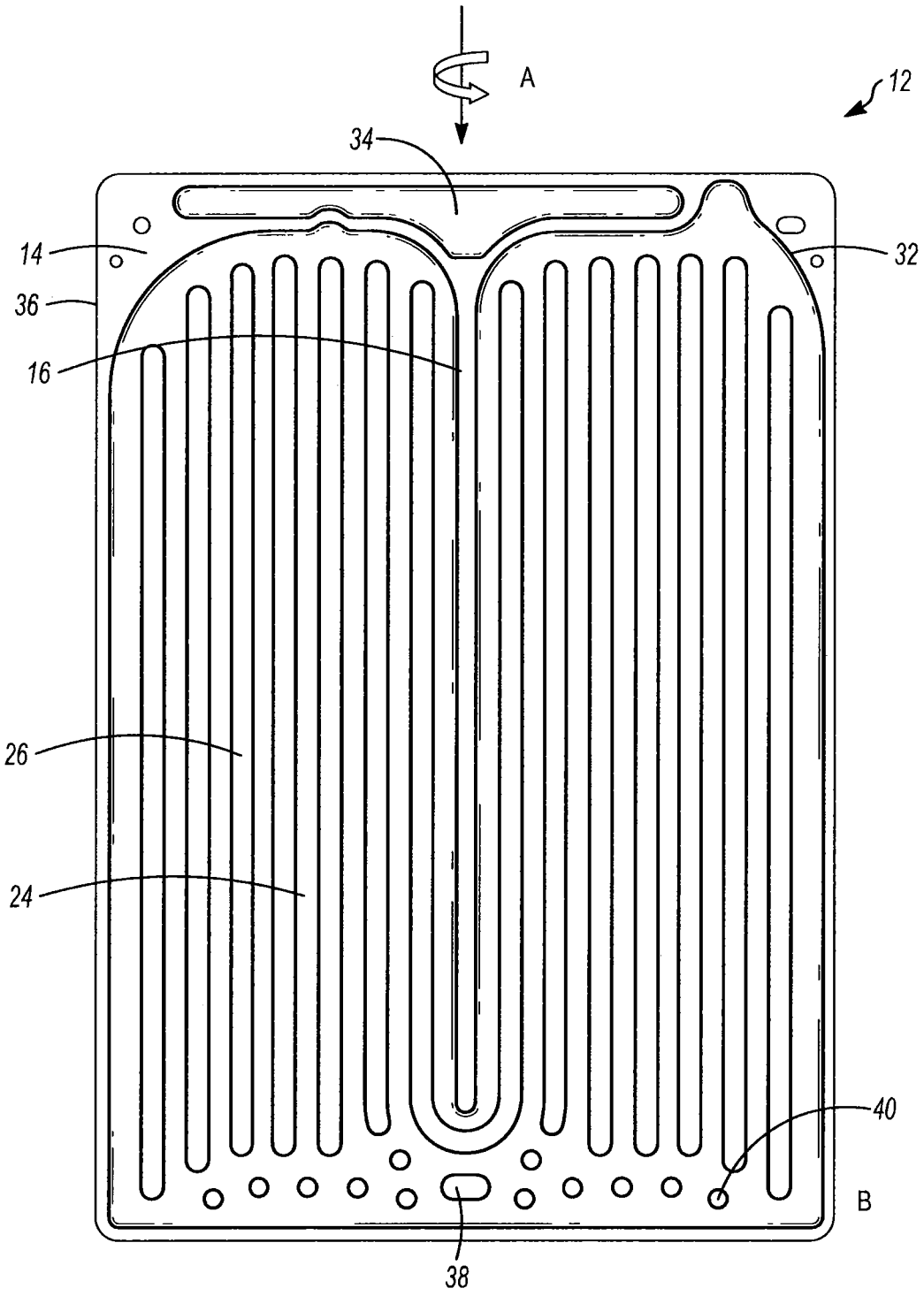
FIG. 3 is a planar view of a heat exchanger plate in accordance with a first embodiment disclosed in the specification.

FIGS. 1-3 relate to a first embodiment of a heat exchanger plate 12 for use in a plate pair of a heat exchanger, in accordance with the specification. The heat exchanger plate 12 is formed using a planar plate 14, and can be stamped, pressed or molded. The heat exchanger plate 12 has a fluid flow portion (18, 20) and peripheral edges 22 that engage and couple with peripheral edges 22 an adjacent heat exchanger plate 12 (not shown). As noted above, during operation, the heat exchanger can experience vibrations due to use of the device or vehicle containing the heat exchanger. These vibrational forces can have an impact on the structure of the heat exchanger plates 12. In a particular embodiment, as shown in FIG. 1, this can result in bending of the heat exchanger plate 12 in Y direction. In particular, FIG. 1 shows the heat exchanger plate 12 prior to deformation and after deformation that can result from such forces.

In the embodiment shown in FIGS. 1-3, the presence of the central rib 16 in the heat exchanger plate 12 separates the heat exchanger plate 12 into an inlet side 18 and an outlet side 20. Further, the central rib 16 can result in structurally rigidity of the heat exchanger plate 12 along the central rib 16. Hence, when encountering vibrational forces, the heat exchanger plate 12 can bend about an axis A (FIG. 3) that extends along the central rib 16. In the embodiment shown in FIGS. 1-3, the axis (A) is present in between the inlet 28 and outlet 30. Such bending can result in the peripheral edges 22 of the heat exchanger plate 12 separating from the peripheral edges of the other adjacent heat exchanger plate (not shown), which together form the plate pair. Further, the bending of the heat exchanger plate 12 about the axis A (FIG. 3) (or in the Y direction as shown in FIG. 1) can result in leakage from the plate pair. In the embodiment shown in FIGS. 1-3, the other plate of the heat exchanger plate pair can be, for example and without limitation, a flat plate. Alternatively, the other (adjacent) heat exchanger plate 12 can be identical to the heat exchanger plate 12 adjacent to it, with the two heat exchanger plates 12 being in a face-to-face relationship.

The heat exchanger plate 12 can be stamped to provide a passage 32 having a plurality of channels 24 and a plurality of ribs 26 on both the inlet side 18 and the outlet side 20. Stamping results in the base of the channels 24 being in a first plane, which is different from the plane defined by the planar plate 14, to allow heat exchanger fluid to flow-in. In the embodiment shown in FIGS. 1-3, the heat exchanger plate 12 is provided with a U-shaped fluid flow passage 32, with the inlet 28 and outlet 30 being adjacent to each other and along the same edge (herein—first edge) of the heat exchanger plate 12.

As noted above, the heat exchanger plate 12 is also provided with an inlet 28 and outlet 30, with the inlet 28 being in fluid communication with the plurality of channels 24 on the inlet side 18, and the outlet 30 being in fluid communication with the plurality of channels 24 on the outlet side 20. Hence, fluid entering from the inlet 28 will flow in the channels 24 on the inlet side 18 till it each reaches the end opposed to the inlet 28 and outlet 30. As the passage ends, the fluid turns and enters the channels 24 on the outlet side 20, flowing to and out from the outlet 30 in the heat exchanger plate 12.

The heat exchanger plate 12 is also provided with a protrusion 34, with the protrusion 34 formed from or coupled to the planar plate 14 and extending away from an axis (A, shown in FIG. 3), with the heat exchanger plate 12 being susceptible to bending about the axis (A). In one embodiment, the protrusion 34 intersects the axis (A) about which the heat exchanger plate 12 is susceptible to bending. In a further embodiment, the protrusion 34 formed from or coupled to the planar plate extends laterally away from the axis (A), where the lateral direction is perpendicular or nearly perpendicular to the axis (A).

In the embodiment shown in FIGS. 1-3, the protrusion 34 extends laterally away from the central rib 16 towards the longitudinal edges 36 of the heat exchanger plate 12. In a further embodiment, as shown in FIGS. 1-3, the protrusion 34 is formed close to the edge of the heat exchanger plate 12 having the inlet 28 and outlet 30. In a still further embodiment, the protrusion 34 is extends from close to one longitudinal edge 36 of the heat exchanger plate 12 to the opposing longitudinal edge 36. In another further embodiment, as shown in FIGS. 1-3, the protrusion 34 is bar-shaped with a centrally positioned pimple shaped projection that centrally projects towards the end of the heat exchanger plate 12 that is opposed to the first end of the heat exchanger plate 12 proximate to the protrusion 34. In still another embodiment, the protrusion 34 extends in the same direction as the channels 24. Hence, the protrusion 34 is present on the external surface of the heat exchanger plate 12 rather than the internal surface where the fluid flows from the inlet 28 to the outlet 30.

In another further embodiment, the heat exchanger plate 12 can be provided with a protuberance 38 that intersects the axis A, with the heat exchanger plate 12 being susceptible to bending about the axis (A). In the embodiment shown in FIGS. 1-3, the protuberance 38 intersects the line that extends along the central rib 16, and extends laterally away towards the longitudinal edges of the heat exchanger plate 12. As shown in FIGS. 1-3, the protuberance 38 is present in the channel 24 (rather than on the planar plate 14, where the protrusion 34 is present) proximate to an end (second end) that is opposed to the first end of the heat exchanger plate 12. In another further embodiment, the protuberance 38 is longitudinal in shape, however, other shapes, such similar to the protrusion 34, as disclosed herein, can also be used.

In still another further embodiment, the heat exchanger plate 12 can be provided with nipples 40. In a particular embodiment, as shown in FIGS. 1-3, the nipples 40 can be provided in the channels 24 (or fluid passage). In a further embodiment, as shown in FIGS. 1-3, the nipples 40 is provided proximate to the protuberance 38. In other words, the nipples 40 can be provided proximate to an end (second end) that is opposed to the first end of the heat exchanger plate 12; and distal from the first edge having the inlet 28 and outlet 30. The nipples 40 can help provide structural rigidity to the heat exchanger plate pair.

Figure 4:
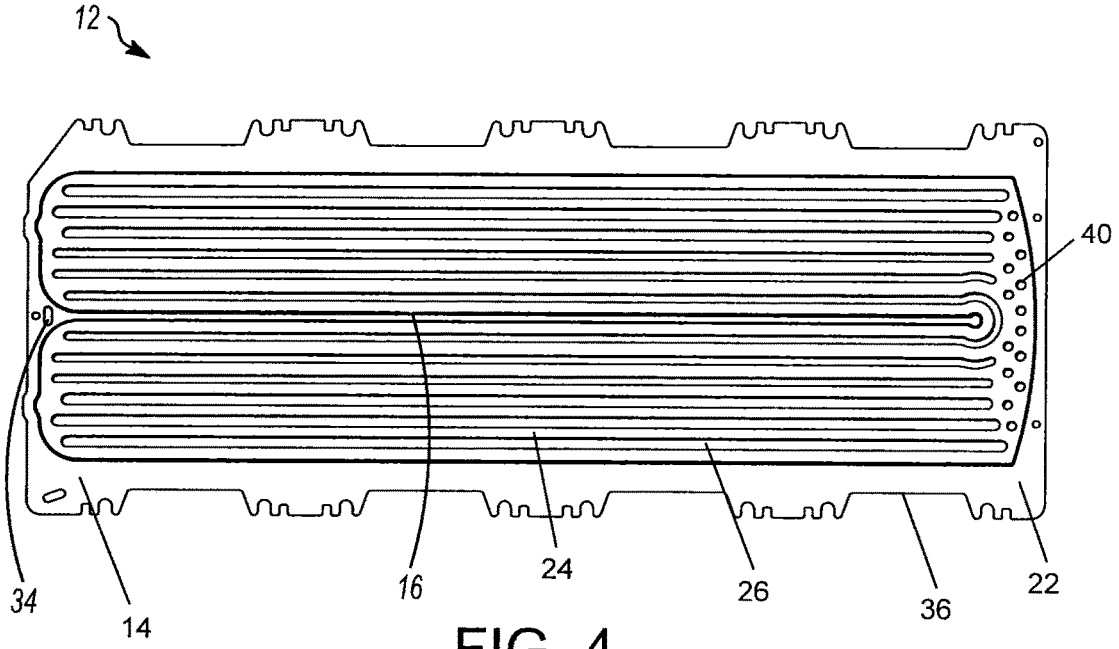
FIG. 4 is a planar view of a heat exchanger plate in accordance with a second embodiment disclosed in the specification.
Figure 5:
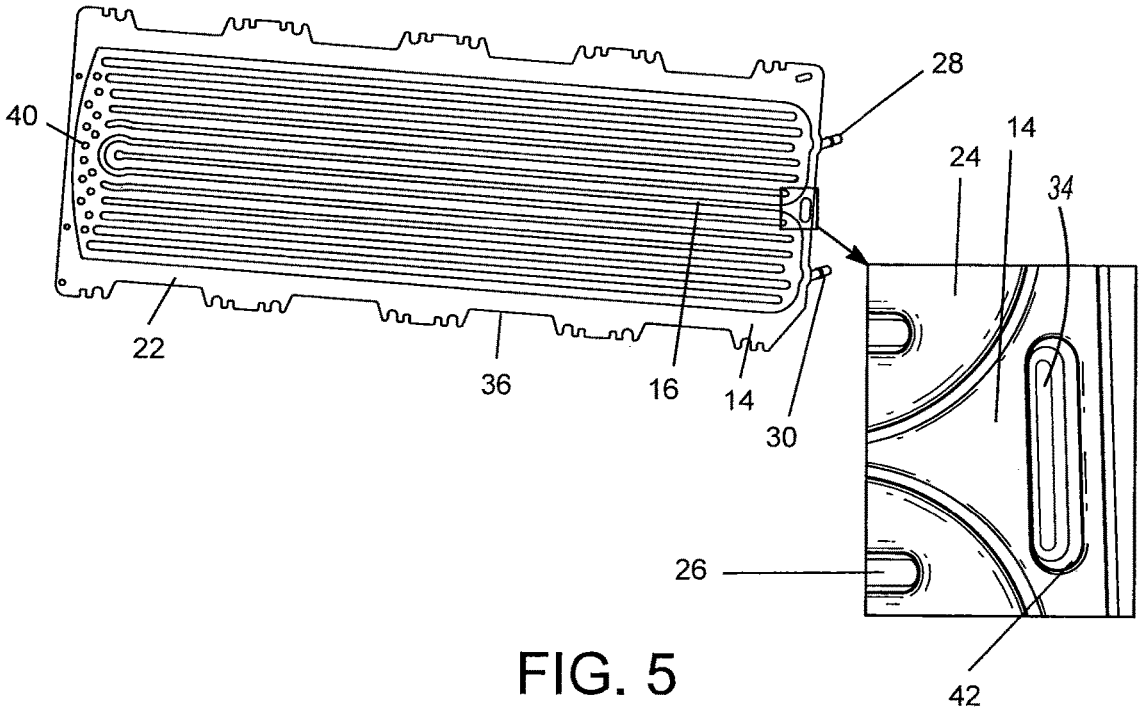
FIG. 5 is a (a) planar view of a heat exchanger plate in accordance with a second embodiment disclosed in the specification, (b) expansion of a portion of a heat exchanger plate in accordance with a second embodiment disclosed in the specification.

FIGS. 4 and 5 show a second embodiment of a heat exchanger plate 12 in accordance with the specification. The heat exchanger plate 12 shown in FIGS. 4 and 5 is similar to the first embodiment shown in FIGS. 1-3, and has a planar plate 14, inlet 28, outlet 30, a plurality of channels 24 and ribs 26, with a central rib 16 separating the plate 12 into an inlet side 18 and an outlet side 20. Similar to the embodiment shown in FIGS. 1-3, the heat exchanger plate 12 shown in FIGS. 4 and 5 can be susceptible bending about the central rib 16.

In one embodiment, the heat exchanger plate 12 is provided with a protrusion 34, with the protrusion 34 being a longitudinal shaped dimple 42 that is positioned on the planar plate 14 (rather than in the channels 24). The longitudinal shaped dimple 42 intersects the axis (A) about which the heat exchanger plate 12 is susceptible to bending and extends laterally away from the axis. In the embodiment shown in FIGS. 4 and 5, the longitudinal shaped dimple 42 is positioned to intersect a line (the axis (A) shown in FIGS. 1-3) that passes along the central rib 16, with the longitudinal shaped dimple 42 extending away from the central rib 16. In a particular embodiment, as shown in FIGS. 4 and 5, the longitudinal shaped dimple 42 is positioned on the planar plate 14 close to the edge having the inlet 28 and outlet 30. In another further embodiment, as shown in FIGS. 4 and 5, the longitudinal shaped dimple 42 has an oblong shape.

Figure 6:
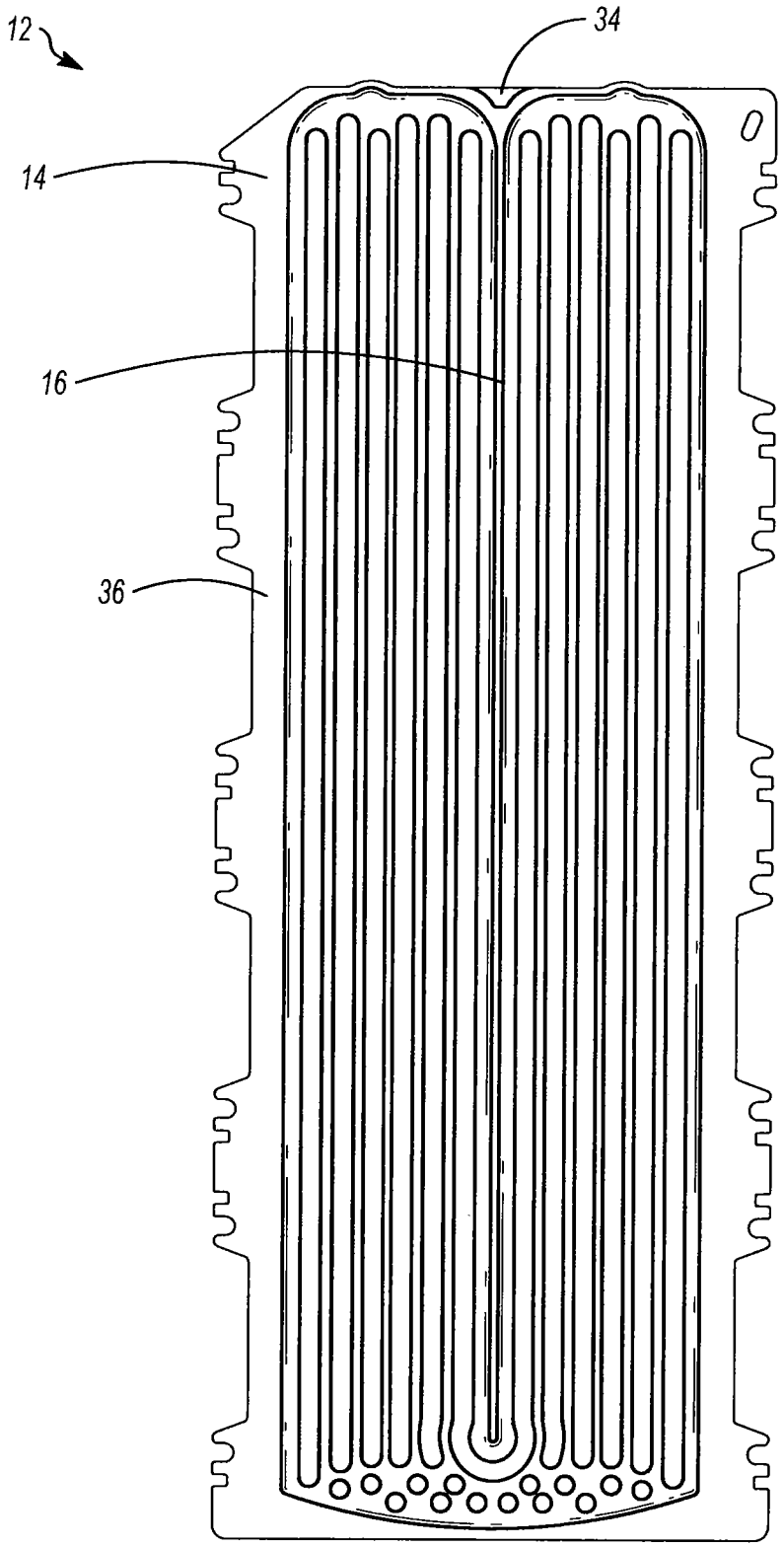
FIG. 6 is a planar view of a heat exchanger plate in accordance with a third embodiment disclosed in the specification.
Figure 7:
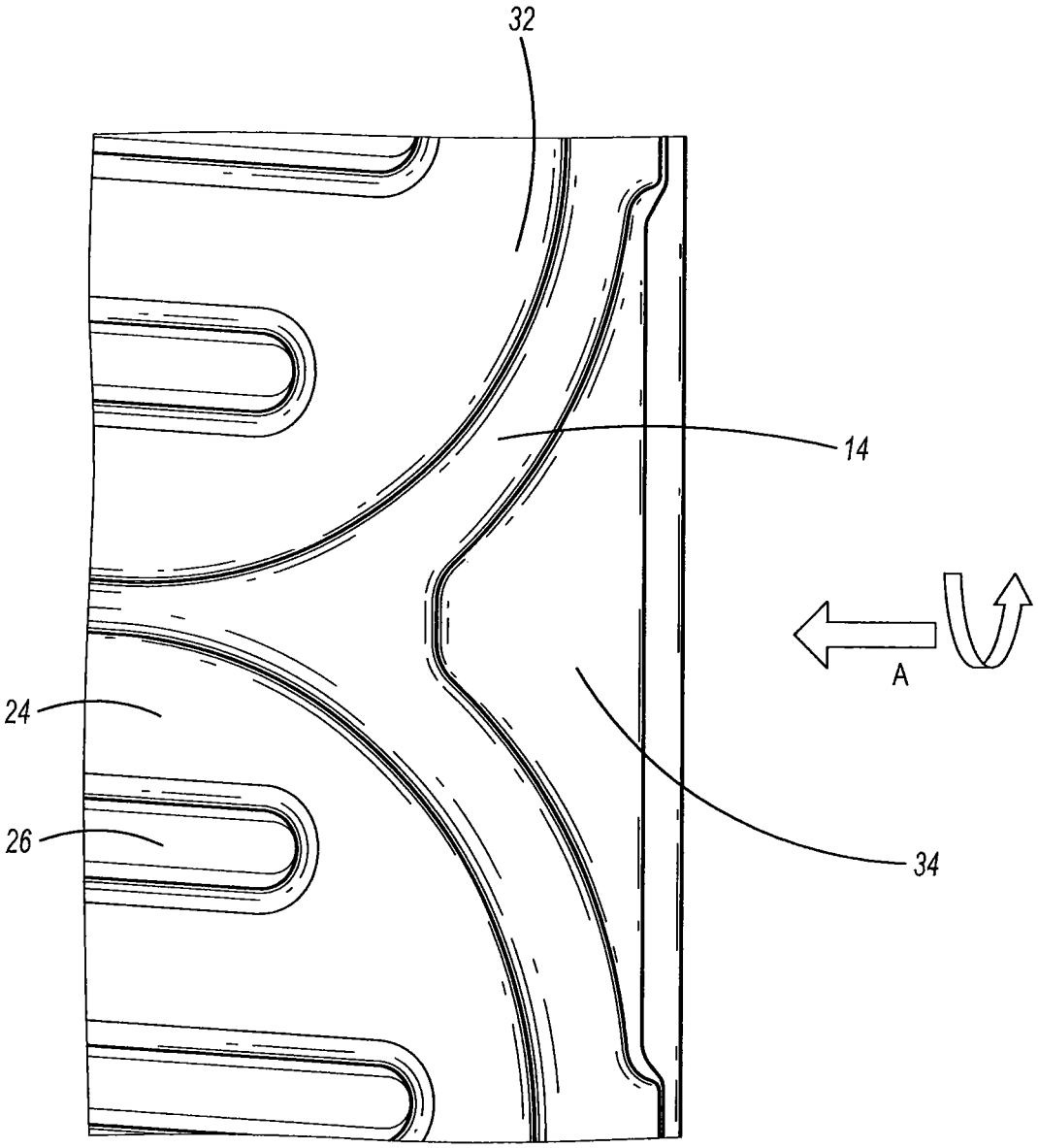
FIG. 7 is an expansion of a portion of a heat exchanger plate in accordance with a third embodiment disclosed in the specification.

FIGS. 6 and 7 relate to a third embodiment of a heat exchanger plate 12 in accordance with the specification. The heat exchanger plate 12 shown in FIGS. 6 and 7 is similar to the heat exchanger plates shown in FIGS. 1-5, and has a planar plate 14, inlet 28, outlet 30, a plurality of channels 24 and ribs 26, with a central rib 16 separating the plate 12 into an inlet side 18 and an outlet side 20. Similar to the embodiment shown in FIGS. 1-5, the heat exchanger plate 12 shown in FIGS. 6 and 7 can be susceptible bending about the central rib 16.

In a particular embodiment, the protrusion 34 is formed on the planar plate 14. In another embodiment, the protrusion 34 extends from an edge (first end) of the heat exchanger plate 12 that is proximate to the inlet 28 or outlet 30. In a further embodiment, the protrusion 34 extends from an edge of the heat exchanger plate 12 that is proximate to the inlet 28 or outlet 30, and is positioned to be symmetrical about an axis (A) about which the heat exchanger plate 12 is susceptible to bending. In still another embodiment, the protrusion 34 extends in the same direction as the channel 24. In a particular embodiment, the protrusion 34 has a triangular shape (as shown in FIGS. 6 and 7), extending from an edge of the heat exchanger plate 12 with the apex of the triangular shaped protrusion 34 being proximate to and inline with (or extending along) the central rib 16.

Figure 8:
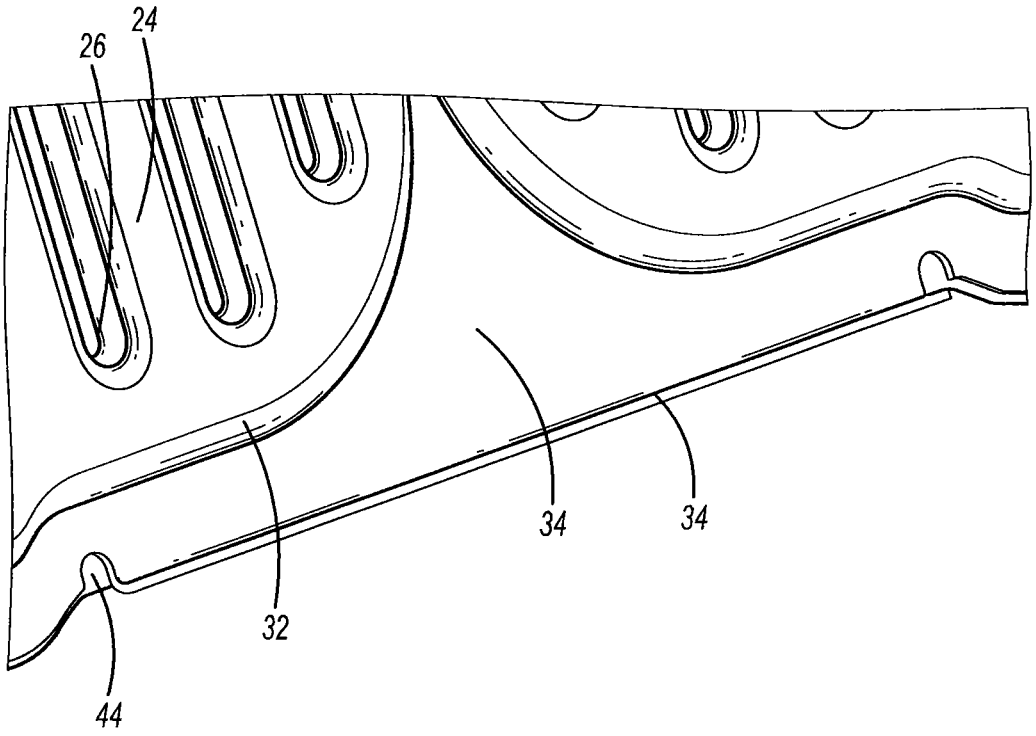
FIG. 8 is an expansion of a portion of a heat exchanger plate in accordance with a fourth embodiment disclosed in the specification.

FIG. 8 shows an alternate embodiment of a protrusion 34 formed by bending an edge of the heat exchanger plate 12, with the bent edge being an edge that extends laterally away from an axis, with the heat exchanger plate being susceptible to bending about the axis. In other words, the embodiment shown in FIG. 8 is provided with a flange (protrusion 34) that extends from the first edge of the heat exchanger plate, with the first end being proximate to the inlet 28 and outlet 30. In the embodiment shown in FIG. 8, the bent edge (or flange) is the edge that is proximate to the heat exchanger inlet 28 and outlet 30. The bent edge (to form the flange) is bent is a direction similar to the channel 24, and away from the complementary plate (the other plate—not shown) of the heat exchanger plate pair. Hence, the heat exchanger plate 12 shown in FIG. 8 is provided with a flange that extends from the edge of the heat exchanger plate 12, and extends laterally away from the axis (A). In one embodiment, for example and without limitation, to form the bent edge (or flange) protrusion 34, the edge of the planar plate 14 can be provided with a pair of cut-outs 44, with the portion of the planar plate 14 in between the cut-outs 44 being bent to form the bent edge (or flange) protrusion 34.

Figure 9:
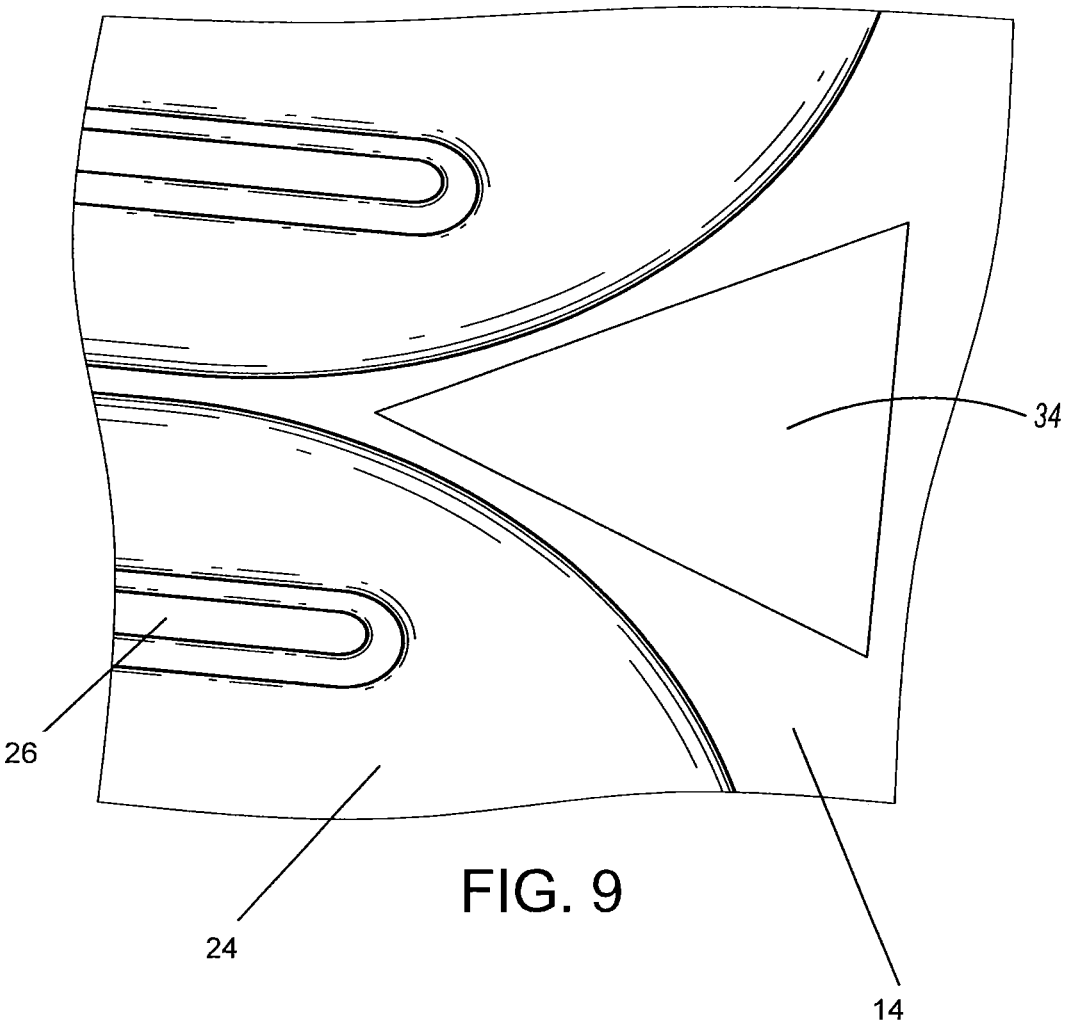
FIG. 9 is an expansion of a portion of a heat exchanger plate in accordance with a fifth embodiment disclosed in the specification.

FIG. 9 shows an alternate embodiment of a protrusion 34, which is triangular in shape, similar to the protrusion 34 shown in FIGS. 6 and 7. However, rather than extending from an edge of the planar plate 14 (as shown in FIGS. 6 and 7), the triangular shaped protrusion 34 shown in FIG. 9 is a stiffening feature provided by brazing, welding or gluing a part or piece to the heat exchanger plate 12, with one side of the triangular shaped protrusion 34 being generally parallel to the edge of the heat exchanger plate 12, and the apex of the triangular shaped protrusion 34 being aligned with the axis about which the heat exchanger plate is susceptible to bending.

Figure 10:
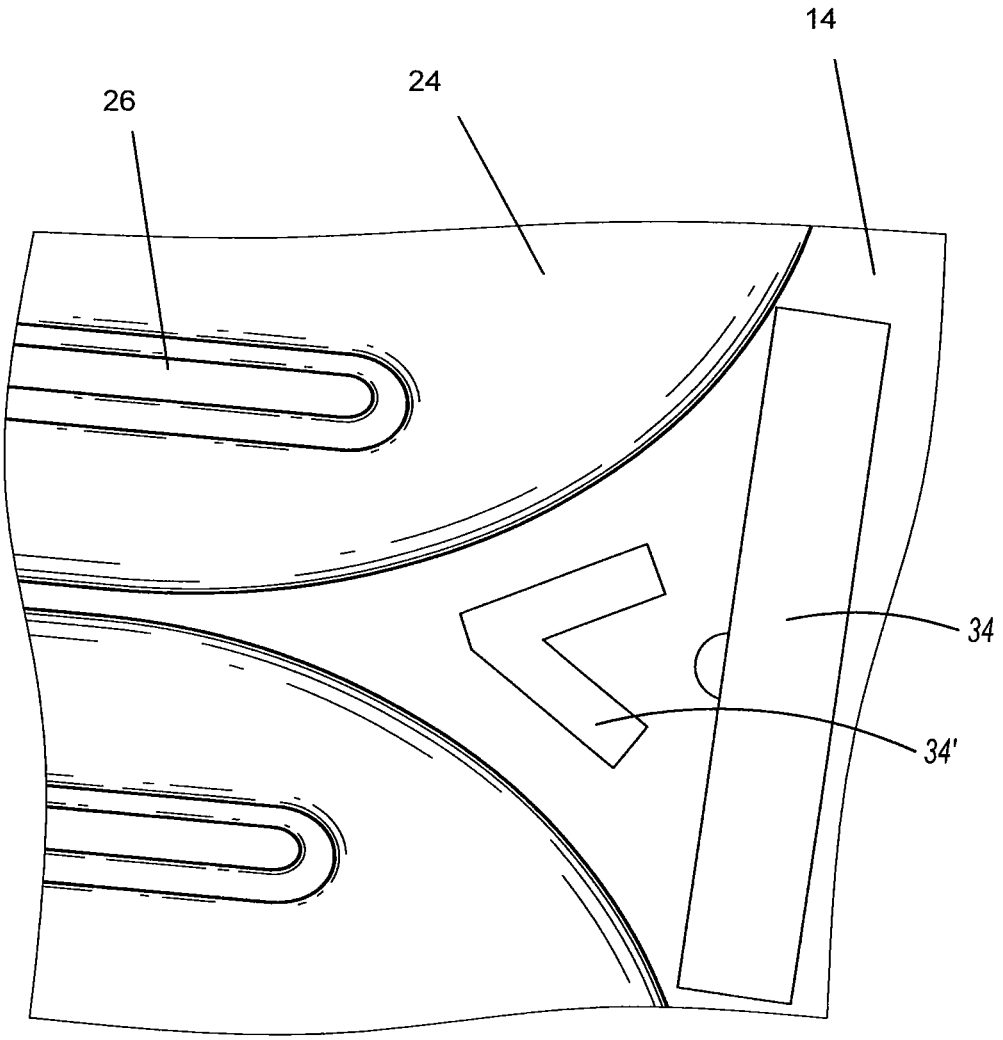
FIG. 10 is an expansion of a portion of a heat exchanger plate in accordance with a sixth embodiment disclosed in the specification.

FIG. 10 shows a further embodiment of a protrusion 34 where separate parts or pieces are brazed, welded or glued as a stiffening feature on a heat exchanger plate 12. In the embodiment shown in FIG. 10, two protrusion 34, 34' (a first protrusion and a second protrusion) are provided on the planar plate 14 of the heat exchanger 12, close to the edge of the heat exchanger 12 that is proximate to the inlet 28 and outlet 30. The first protrusion 34 is generally rectangular, extending from one longitudinal edge to the opposing longitudinal edge of the heat exchanger plate 12. In other words, the first protrusion 34 extends laterally away from an axis, with the heat exchanger plate being susceptible to bending about the axis. The second protrusion 34' is V-shaped with the apex of the V-shaped protrusion 34' being aligned with the central rib 16 of the heat exchanger plate 12. In other words, the apex of the V-shaped protrusion 34' extends along an axis about which the heat exchanger plate 12 is susceptible to bending. In the embodiment shown in FIG. 10, the first protrusion 34 is more proximate to the first edge of the heat exchanger plate 12 than the second protrusion 34'.

Figure 11:
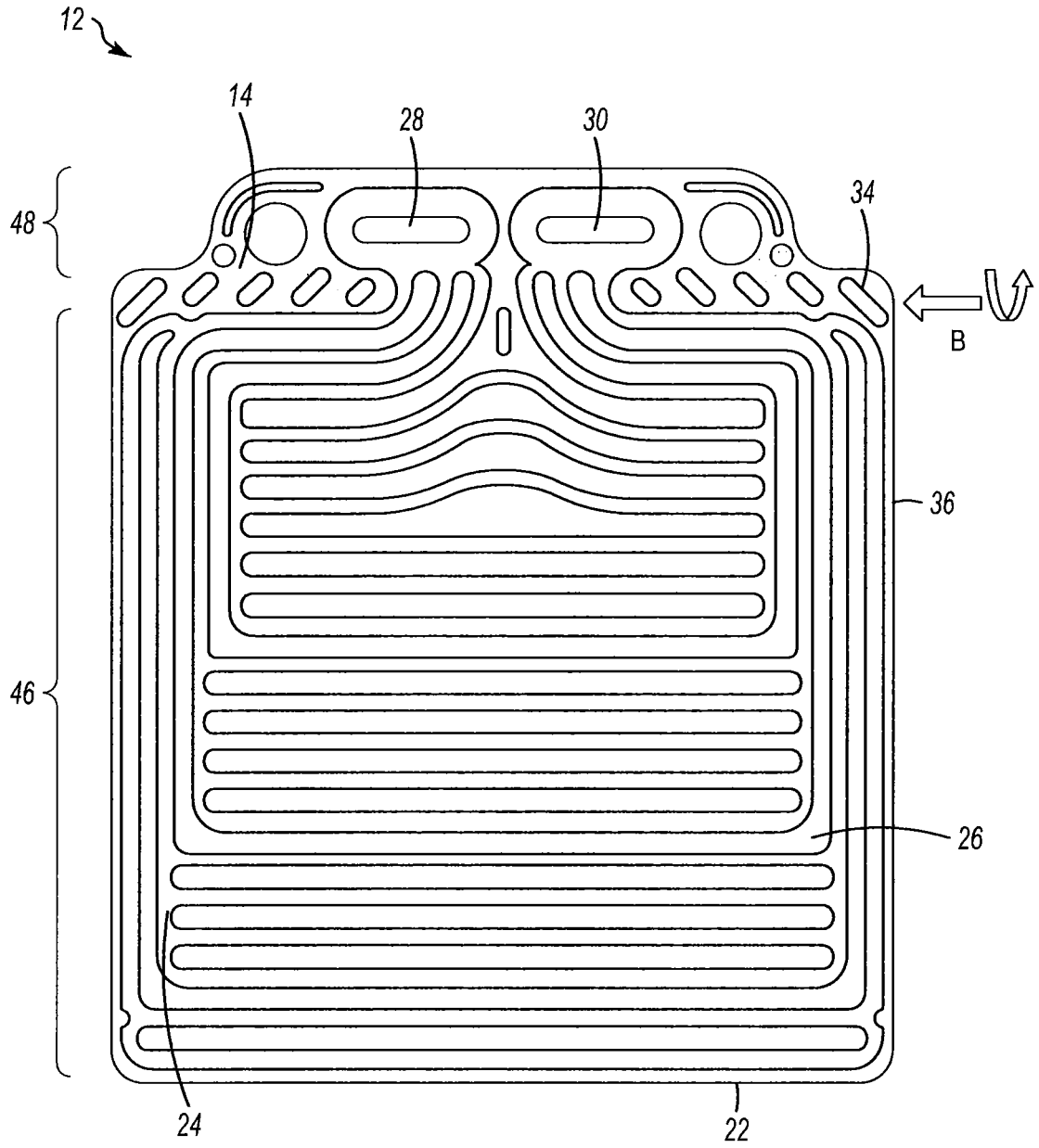
FIG. 11 is a planar view of a heat exchanger plate in accordance with a seventh embodiment disclosed in the specification.

FIG. 11 shows an embodiment of a heat exchanger plate 12 that can be used as a battery cooler. Example of a battery cooler is disclosed in PCT Patent Publication No. WO/2017/070785, incorporated herein by reference. The heat exchanger plate 12 shown in FIG. 11 can be separated into a heat exchange side 46 and a manifold side 48. The heat exchange side 46 allows for heat exchange with the device with which the heat exchanger plate 12 is in contact with, while the manifold side 48 having the inlet 28 and outlet 30, permitting flow of a heat exchange fluid from one heat exchanger plate pair to another heat exchanger plate pair, and also permitting flow of the heat exchange fluid to flow from the inlet 28 on the manifold side 48 to the channels 24 of the heat exchange plate 12 on the heat exchanger side 46.

The heat exchanger plate 12 shown in FIG. 11 can be susceptible to bending about an axis (B) between the heat exchanger side 46 and the manifold side 48. In the embodiment shown in FIG. 11, the axis (B) is adjacent to both the inlet 28 and outlet 30, and extends from one longitudinal edge of the heat exchanger plate 12 to the opposing longitudinal edge of the heat exchanger plate 12. Like earlier embodiments disclosed herein, the inlet 28 and outlet 30 are present adjacent to each other, along an edge (first edge) of the heat exchanger plate 12, with the axis (B) being parallel to the first edge that has the inlet 28 and outlet 30.

To help prevent bending about the axis (B), the planar plate 14 of the heat exchanger plate 12 is provided with a plurality of protrusions 34, with each protrusion 34 of the plurality of the protrusions 34 extending away from an axis (B) about which the heat exchanger plate is susceptible to bending. In one embodiment, as shown in FIG. 11, each of the plurality of protrusions 34 is longitudinal in shape and intersects the axis (B) about which the heat exchanger plate 12 is susceptible to bending. In a further embodiment, each of the protrusions 34 is sloped relative to the longitudinal length of the heat exchanger plate 12. Further, although the protrusions 34 are sloped in the same direction, as shown in FIG. 11, the protrusions 34 can be sloped in opposing directions, with some protrusions extending along the length of the heat exchanger plate 12. In another further embodiment, other shapes of protrusions 34, such as those shown in FIGS. 1-10, can be used, so long as they extend away from an axis, with the heat exchanger plate being susceptible to bending about the axis.

Certain adaptations and modifications of the described embodiments can be made. Therefore, the above discussed embodiments are considered to be illustrative and not restrictive.

Parts list

| No. | Description |
|---|---|
| 12 | Heat exchanger plate |
| 14 | planar plate |
| 16 | central rib |

-continued

Parts list

| No. | Description |
|---|---|
| 18 | inlet side |
| 20 | Outlet side |
| 22 | peripheral edges |
| 24 | plurality of channels |
| 26 | plurality of ribs |
| 28 | Inlet |
| 30 | Outlet |
| 32 | Passage |
| 34 | Protrusion |
| 36 | longitudinal edges |
| 38 | Protuberance |
| 40 | Nipple |
| 42 | Dimple |
| 44 | Cut-out |
| 46 | Heat exchange side |
| 48 | Manifold side |

What is claimed is:

1. A heat exchanger plat; comprising:

a planar plate having an inlet and outlet proximate to a first edge of the heat exchanger plate and having a central rib extending along the length of the heat exchanger plate and separating the planar plate into an inlet side and an outlet side;

the heat exchanger plate having a plurality of ribs and a plurality of channels, with a base of the plurality of channels being in a plane different from the planar plate, the plurality of channels being in fluid communication from the inlet to the outlet permitting fluid flow from the inlet to the outlet; and a protrusion coupled to the planar plate proximate to the first edge of the heat exchanger plate and extending away from an axis, with the heat exchanger plate being susceptible to bending about the axis and the axis extends in line with the central rib.

2. The heat exchanger plate according to claim 1, wherein the planar plate provides a U-shaped fluid flow path from the inlet to the outlet.

3. The heat exchanger plate according to claim 1, wherein the protrusion laterally extends away from the axis and intersects the axis, the protrusion being bar shaped with a centrally positioned pimple-shaped projection that projects from the protrusion along the central rib towards an edge of the heat exchanger plate that is opposed to the first edge.

4. The heat exchanger plate according to claim 1, wherein the protrusion is a longitudinal shaped dimple positioned adjacent to the first edge of the heat exchanger plate and laterally extending away from the axis, the longitudinal shaped dimple intersecting the axis along which the heat exchanger plate is susceptible to bending.

5. The heat exchanger plate according to claim 1, wherein the protrusion has a triangular shape and extends from the first edge of the heat exchanger plate, the apex of the triangular shaped protrusion being proximate to and in line with the central rib.

6. The heat exchanger plate according to claim 1, wherein the protrusion laterally extends away from the axis and the protrusion is a flange extending from the first edge of the heat exchange plate.

7. The heat exchanger plate according to claim 1, wherein the protrusion has a triangular shape and is coupled adjacent to the first edge of the heat exchanger plate, the apex of the triangular shaped protrusion being proximate to and in line with the central rib.

8. The heat exchanger plate according to claim 1, wherein the protrusion comprises a first protrusion and a second protrusion, the first protrusion being longitudinal in shape and coupled to the planar plate proximate to the first edge of the heat exchanger plate and laterally extending away from the axis, with the heat exchanger plate being susceptible to bending about the axis; and the second protrusion being V-shaped with the apex of the V-shaped protrusion being aligned with the central rib of the heat exchanger plate.

9. The heat exchanger plate according to claim 1, further comprising a protuberance positioned in the channel proximate to an edge opposed to the first edge, the protuberance intersects the axis about which the heat exchanger plate is susceptible to bending and extends laterally away towards the longitudinal edges of the heat exchanger plate.

10. A heat exchanger plate, comprising:

a planar plate having an inlet and outlet proximate to a first edge of the heat exchanger plate;

the heat exchanger plate having a plurality of ribs and a plurality of channels, with a base of the plurality of channels being in a plane different from the planar plate, the plurality of channels being in fluid communication from the inlet to the outlet permitting fluid flow from the inlet to the outlet;

a protrusion coupled to the planar plate proximate to the first edge of the heat exchanger plate and extending away from an axis, with the heat exchanger plate being susceptible to bending about the axis; and a plurality of nipples formed in the channel and extending in the fluid passage.

11. The heat exchanger plate according to claim 10, wherein the plurality of nipples are formed proximate to an edge opposed to the first edge.

12. The heat exchanger plate according to claim 10, wherein the heat exchanger plate has a manifold portion and a heat exchanger portion, the heat exchanger plate provided with a plurality of protrusions between the manifold portion and the heat exchange portion; and wherein the heat exchanger is susceptible to bending in between the manifold portion and the heat exchanger portion.

13. The heat exchanger plate according to claim 12, wherein the axis about which the heat exchanger plate is susceptible to bending is perpendicular to the length of the heat exchanger plate.

14. The heat exchanger plate according to claim 12, wherein the plurality of protrusions are at an angle from the length of the heat exchanger plate.

15. A heat exchanger plate, comprising:

a planar plate;

a plurality of ribs and a plurality of channels formed into the planar plate such that a base of the plurality of channels is in a plane different from the planar plate;

an inlet and an outlet connected to the plurality of channels; and a protrusion formed on the planar plate and separate from the plurality of channels, and the protrusion extending perpendicularly to and away from a central rib of the plurality of ribs.

16. The heat exchanger plate of claim 15, wherein the protrusion is formed as a dimple in the planar plate separate from the plurality of channels.

17. The heat exchanger plate of claim 15, wherein the protrusion further extends in the direction of the central rib.

18. The heat exchanger plate of claim 15, wherein the protrusion is formed as a bent edge of the planar plate.

19. The heat exchanger plate of claim 15, further comprising a protuberance positioned in one or more of the plurality of channels on an end of the heat exchanger plate opposite the protrusion and the protuberance extending perpendicularly to the central rib.

* * * * *